US006279355B1

(12) United States Patent
Chiang

(10) Patent No.: US 6,279,355 B1
(45) Date of Patent: Aug. 28, 2001

(54) STRUCTURE OF KNITTING MACHINE

(76) Inventor: Chin-I Chiang, No. 56, Chu Kao Tso, Lin 13, Tachu Li, Pa Te City, Tao Yuan Hsien (TW)

( * ) Notice: Subject to any disclaimer, the term of this patent is extended or adjusted under 35 U.S.C. 154(b) by 0 days.

(21) Appl. No.: 09/696,286

(22) Filed: Oct. 26, 2000

(51) Int. Cl.[7] ..... D04B 15/00
(52) U.S. Cl. ..... 66/8
(58) Field of Search ..... 66/8, 19, 57

(56) References Cited

U.S. PATENT DOCUMENTS

| | | | | |
|---|---|---|---|---|
| 309,820 | * | 12/1884 | Cooper | 66/8 |
| 954,932 | * | 4/1910 | Cook | 66/8 |
| 2,436,241 | * | 2/1948 | Wytovich | 66/8 |
| 5,613,375 | * | 3/1997 | Renda et al. | 66/8 |

* cited by examiner

*Primary Examiner*—Danny Worrell
(74) *Attorney, Agent, or Firm*—Bacon & Thomas, PLLC

(57) ABSTRACT

A convertible circular knitting machine having mechanical main body, cylinder mechanisms, yarn feeders, and a fabric winding system. The cylinders are mounted on the top of the base of the main body. The upper and lower cylinder mechanisms are driven by synchronous shafts. The yarn is transmitted from yarn feeders to cylinders and then knitted to clothes and wound by the fabric winding system. The apparatus is characterized in that upper and lower cylinder mechanisms are all interchangeable so that the upper cylinder can be replaced with radial dust cleaning system. In addition, an upper support rack and a set of rings for feeding thread can be mounted on the base. Therefore, the present invention has multi-functions, wherein the upper and lower cylinders can be adjusted or replaced, or added with optional elements such as an upper support rack, rings for feeding thread and radial dust cleaning system in order to convert the model of producing fabric and offer a wide range of applications.

4 Claims, 8 Drawing Sheets

STRUCTURE OF KNITTING MACHINE

BACKGROUND OF THE INVENTION

1. Field of the Invention

The present invention relates to an improved knitting machine, particularly a multi-function machine which is adapted to producing several types of fabrics including single knit, plain terry, double knit, single jacquard, double jacquard.

2. Description of the Prior Art

A conventional knitting machine can only knit using one method and thus produces a single type of fabric such as single knit, double knit, or jacquard. Although the configuration and structure of these machines vary only slightly, they often cannot be arranged to knit using different methods. Thus, a knitting factory needs to purchase different machines having different functions in order to meet the needs of producing different kinds of fabrics so as to meet different demands of clients and seasonal change. Due to changing fashions and seasons, the amount and type of the fabrics also change over time. Thus, different types and amounts of fabric are needed at different times, therefore leaving some machines inoperable at any given moment. Furthermore, knitting machines are expensive and occupy a significant amount of space on the factory floor.

SUMMARY OF THE INVENTION

Therefore, it is the primary object of the present invention to provide an improved knitting machine having interchangeable components such as upper and lower cylinder mechanisms, a dust cleaning system, and rings for fixing thread. By the design of the present invention, the components can be converted and replaced simply and conveniently in order to achieve the shift in functions and avoid the waste of cost of machines.

According to the above object, the main components of the present invention include mechanical main body, cylinder mechanism, yarn feeders, and fabric winding system. The cylinders are mounted on the top of the base of the main body. The upper and lower cylinder mechanisms are driven by synchronous shafts. The yarn is transmitted from yarn feeders to cylinders and then knitted to clothes and wound by the fabric winding system. The apparatus is characterized in that upper and lower cylinder mechanisms are all interchangeable so that the upper cylinder can be replaced with radial dust cleaning system. In addition, an upper support rack and a set of rings for feeding thread can be mounted on the base. Therefore, the present invention has multifunctions, wherein the upper and lower cylinders can be adjusted or replaced, or added with optional elements such as an upper support rack, rings for feeding thread and radial dust cleaning system in order to convert the model of producing fabric from one to another.

The foregoing object and advantages of the present invention will be more apparent from the following detailed description, as taken in conjunction with the accompanying drawings wherein;

DETAILED DESCRIPTION OF THE PREFERRED EMBODIMENT

Figure 1:
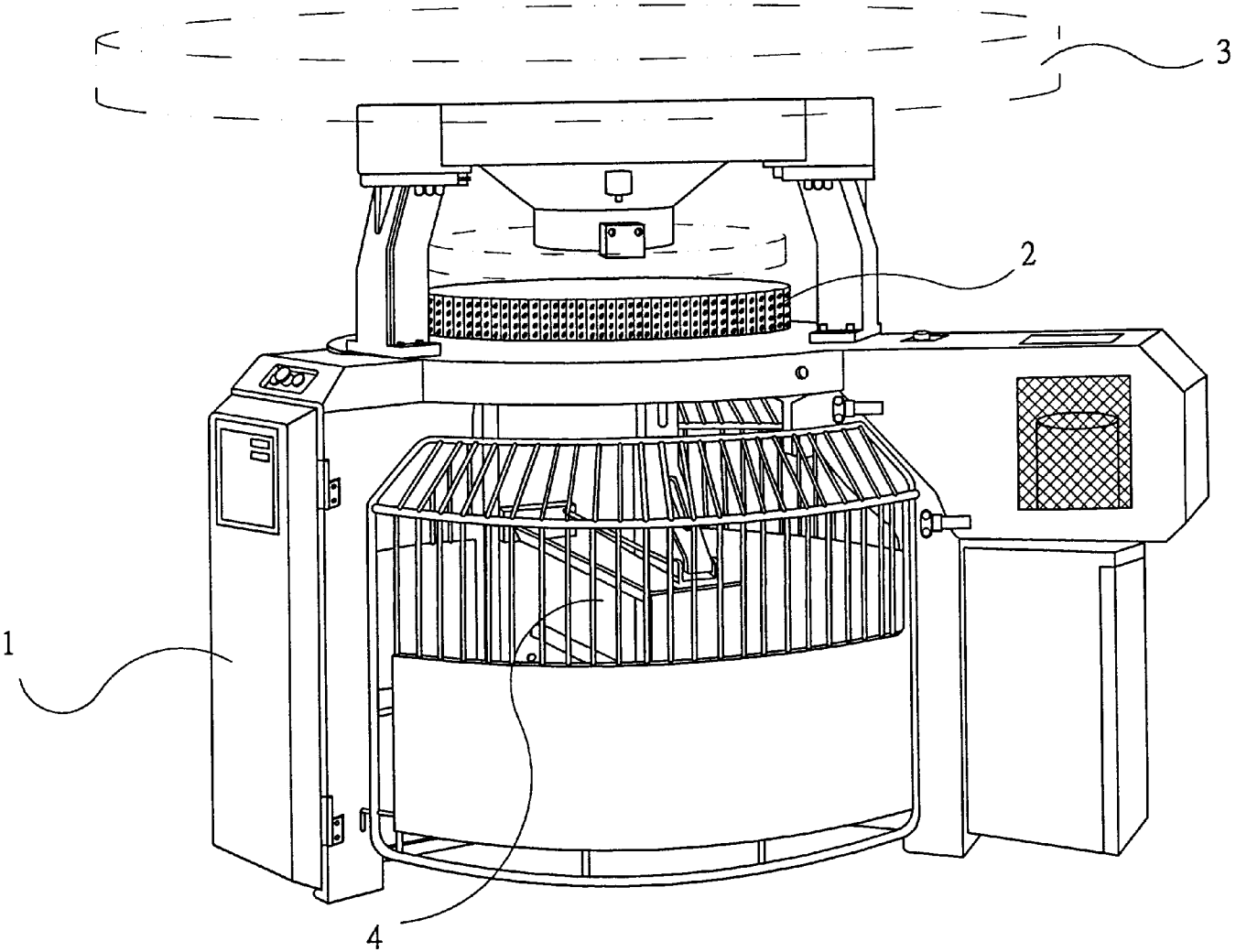
FIG. 1 is the perspective view of the present invention.
Figure 2:
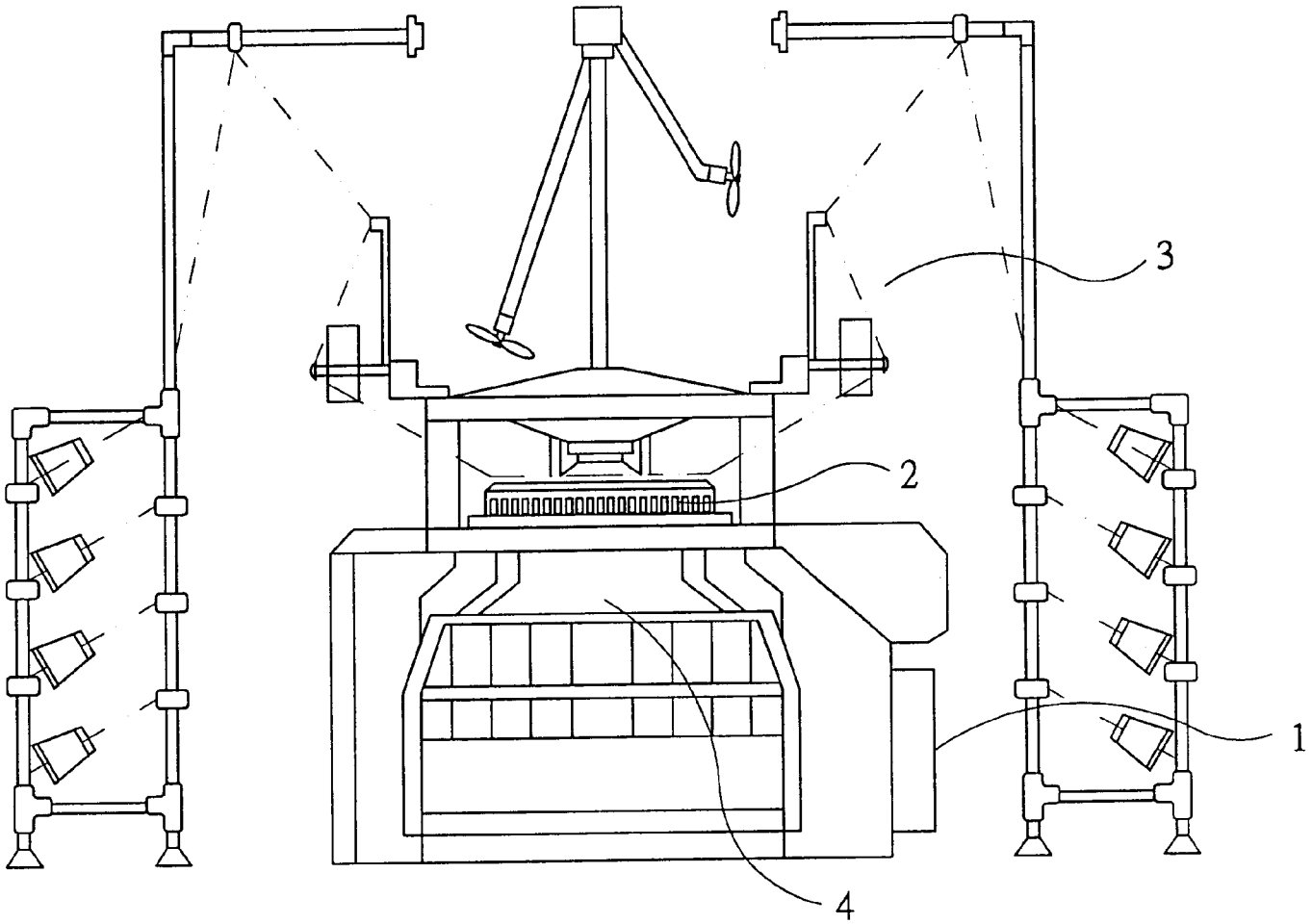
FIG. 2 is the assembling view of the present invention.
Figure 3:
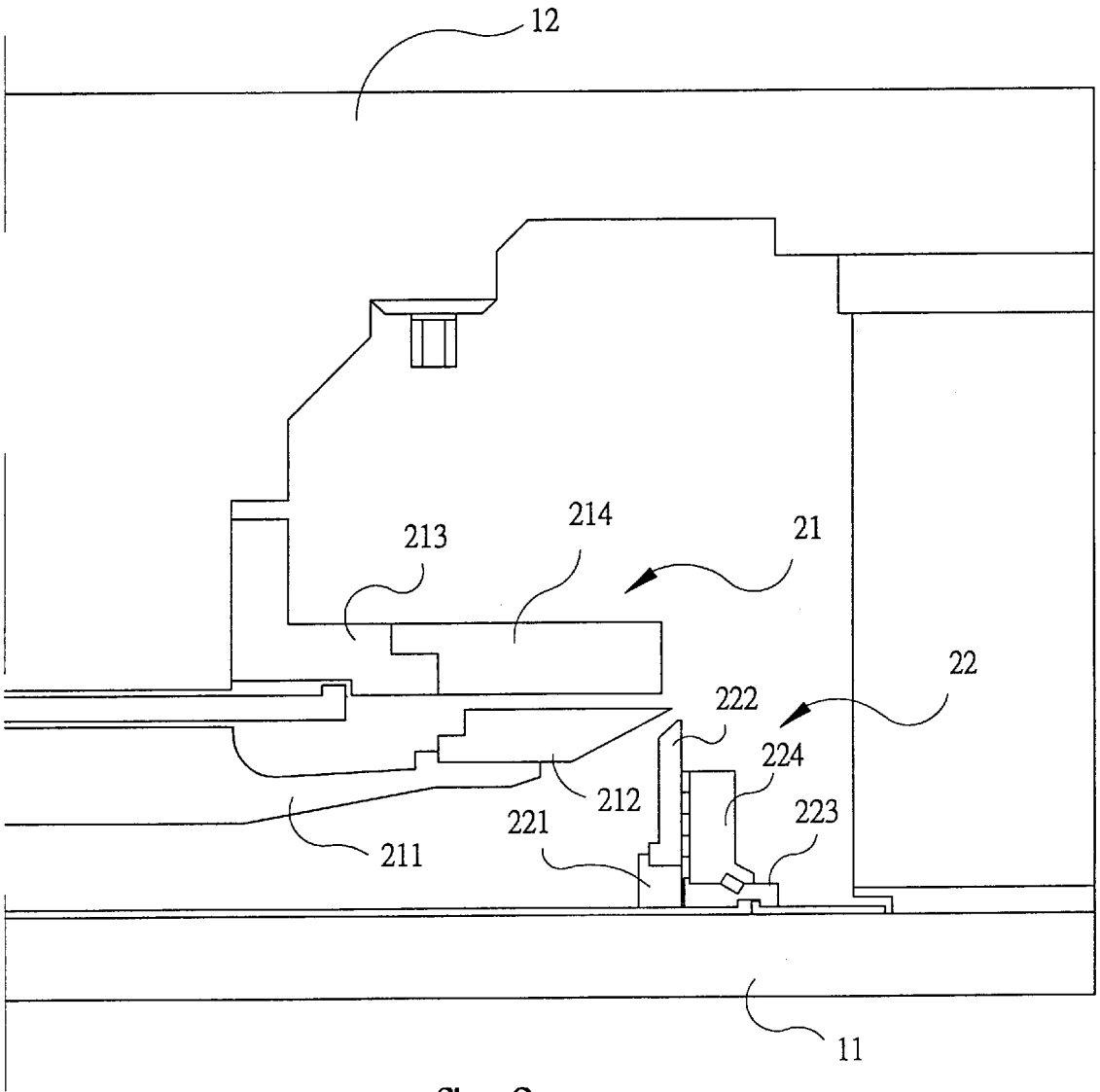
FIG. 3 is the parts location view of the present invention as double knit machine.
Figure 7:
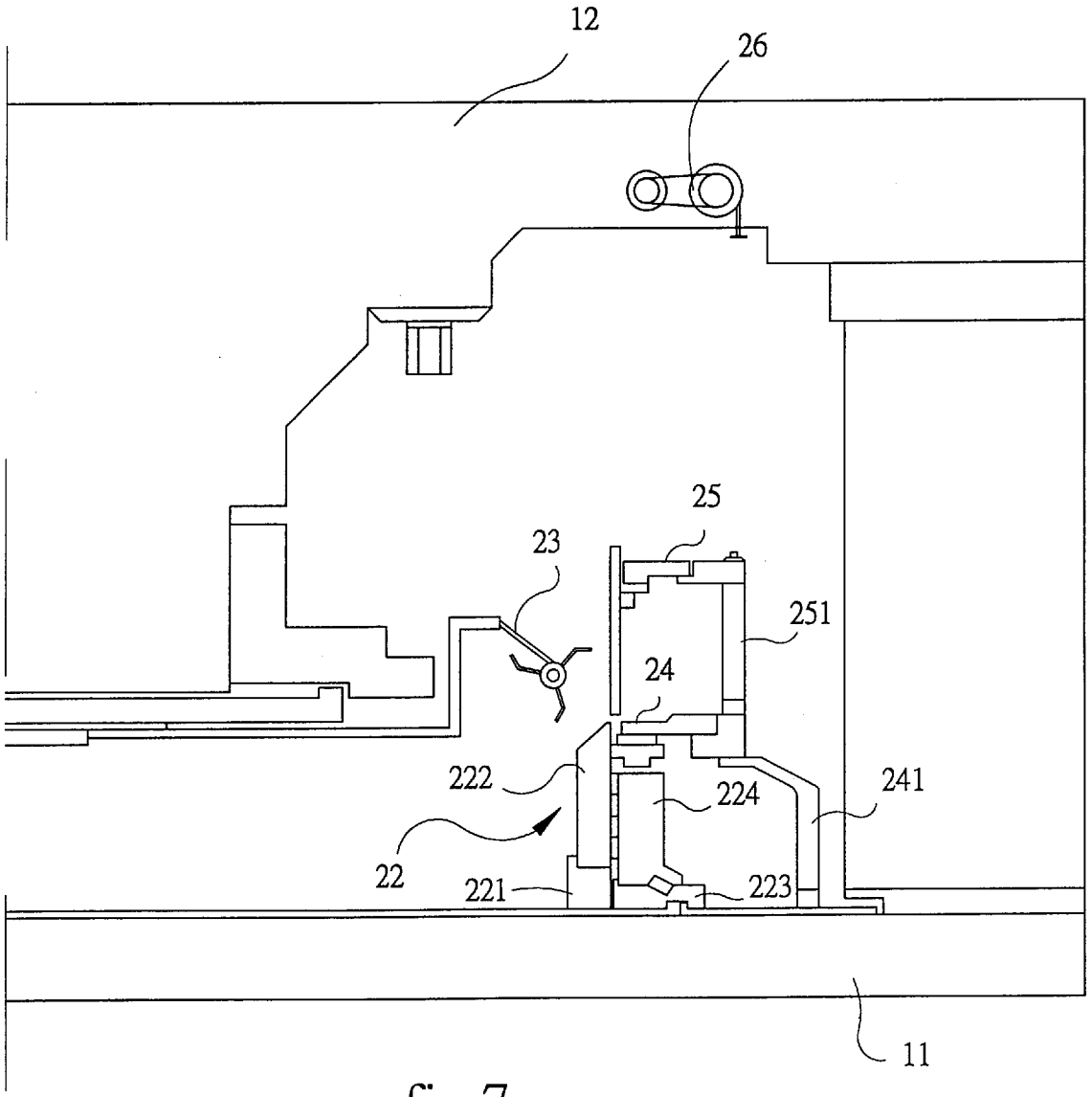
FIG. 7 is the parts location view of the present invention as single knit machine.

Referring to FIGS. 1 & 2, the present invention comprises a mechanical main body (1), a cylinder mechanism (2), yarn feeders (3), and a fabric winding system (4). The yarn from the yarn feeders (3) is knitted to clothe through cylinder mechanisms (2) and is winded by the fabric winding system (4). As shown in FIG. 3, the cylinder mechanism (2) has an upper (21) and a lower (22) cylinder mechanism which are disposed at the top of the base (11) of the main body (1), whereon the lower cylinder mechanism (22) is fixed at the base (11) and the upper cylinder mechanism (21) is mounted on the main strut seat (12) which is above the base (11). The upper and lower cylinders are driven by respective synchronous shafts. The present invention is characterized by a cylinder mechanism (2) having a moveable upper cylinder mechanism (21) and a lower cylinder mechanism (22) wherein the upper cylinder mechanism 21 can be replaced by different modules. In addition, as shown in FIG. 7 an upper support rack (24) and rings for fixing thread (25) can be added on the base (11) of the main body (1). Therefore, the present invention comprises interchangeable upper and lower cylinder mechanisms (21) (22) an optional upper support rack (24), rings for fixing thread (25) and a dust cleaning system (23).

An embodiment of the present invention for producing double knit fabric is shown in FIG. 3. A lower cylinder mechanism (22) is mounted on the base (11) of the main body (1) and the upper cylinder mechanism (21) suspended from main strut seat (12). A upper cylinder seat (211) is fixed on the central shaft of the upper cylinder mechanism (21) with the upper cylinder (212) therein. A circular seat (213) is disposed at the lower part of the main strut seat (12) with upper block ring (214) therein, located just above the upper cylinder (212). While the lower cylinder mechanism (22) having lower cylinder seat (221) with lower cylinder (222) therein fixed on the base (11) of the main body (1) and the lower block ring (224) mounted on the bottom seat (223). Upper block ring (214) and lower block ring (224) include a plurality of blocks with needle tracks therein so that the needles can transfer through the track when the upper (212) and lower cylinders (222) rotate.

Moreover, when the present invention converts the model from producing this fabric to another fabric, the bottom base (223) of the lower block ring (224) also needs to be replaced due to the different number of yarn feed and gauge, and then follows the above-mentioned steps for replacing other components. The above-mentioned upper block ring (214) and lower block ring (224) include a plurality of blocks thereon.

Figure 4:
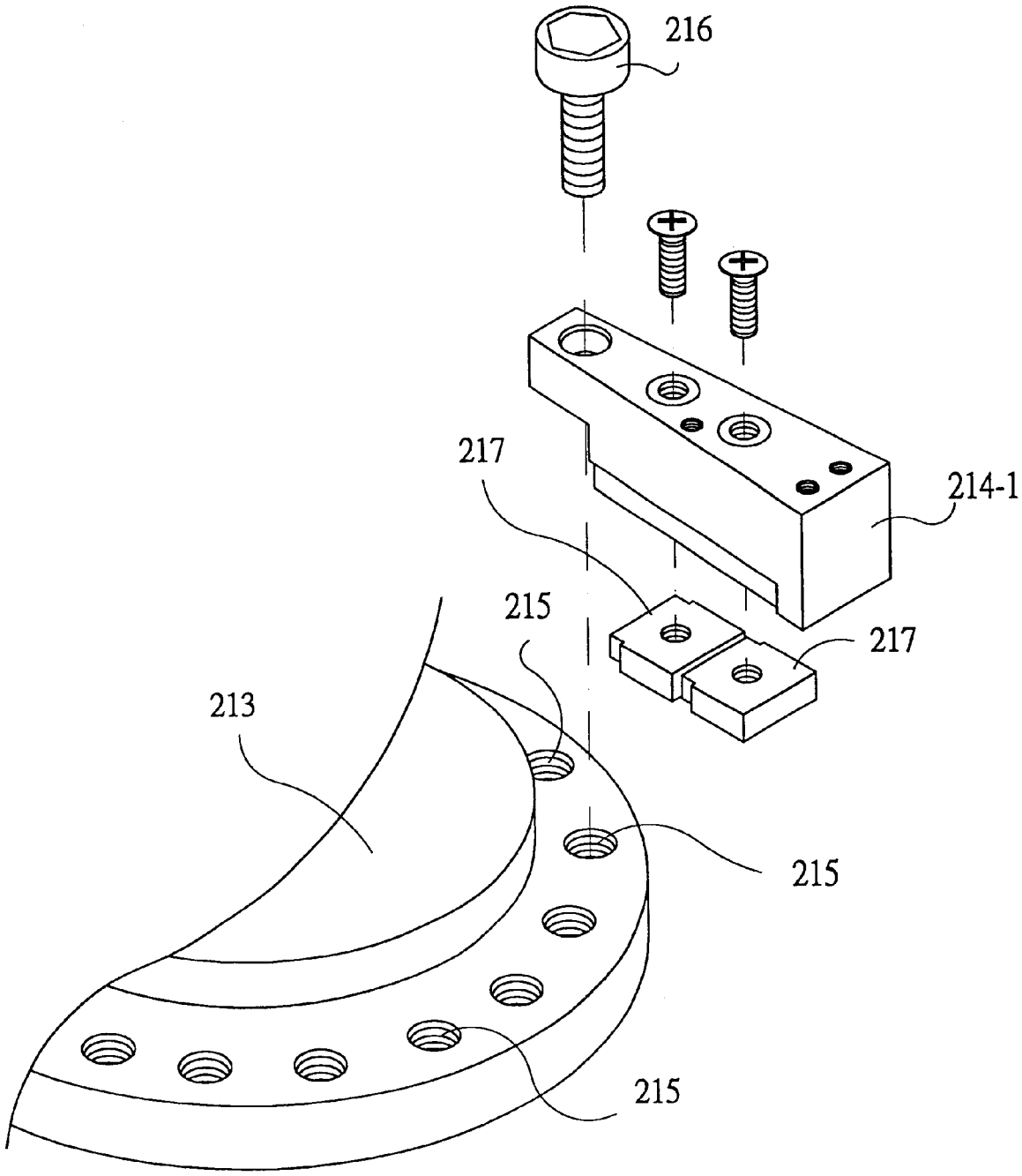
FIG. 4 is the explosive view of the block of the upper block ring and circular seat of the upper cylinder mechanism.
Figure 5:
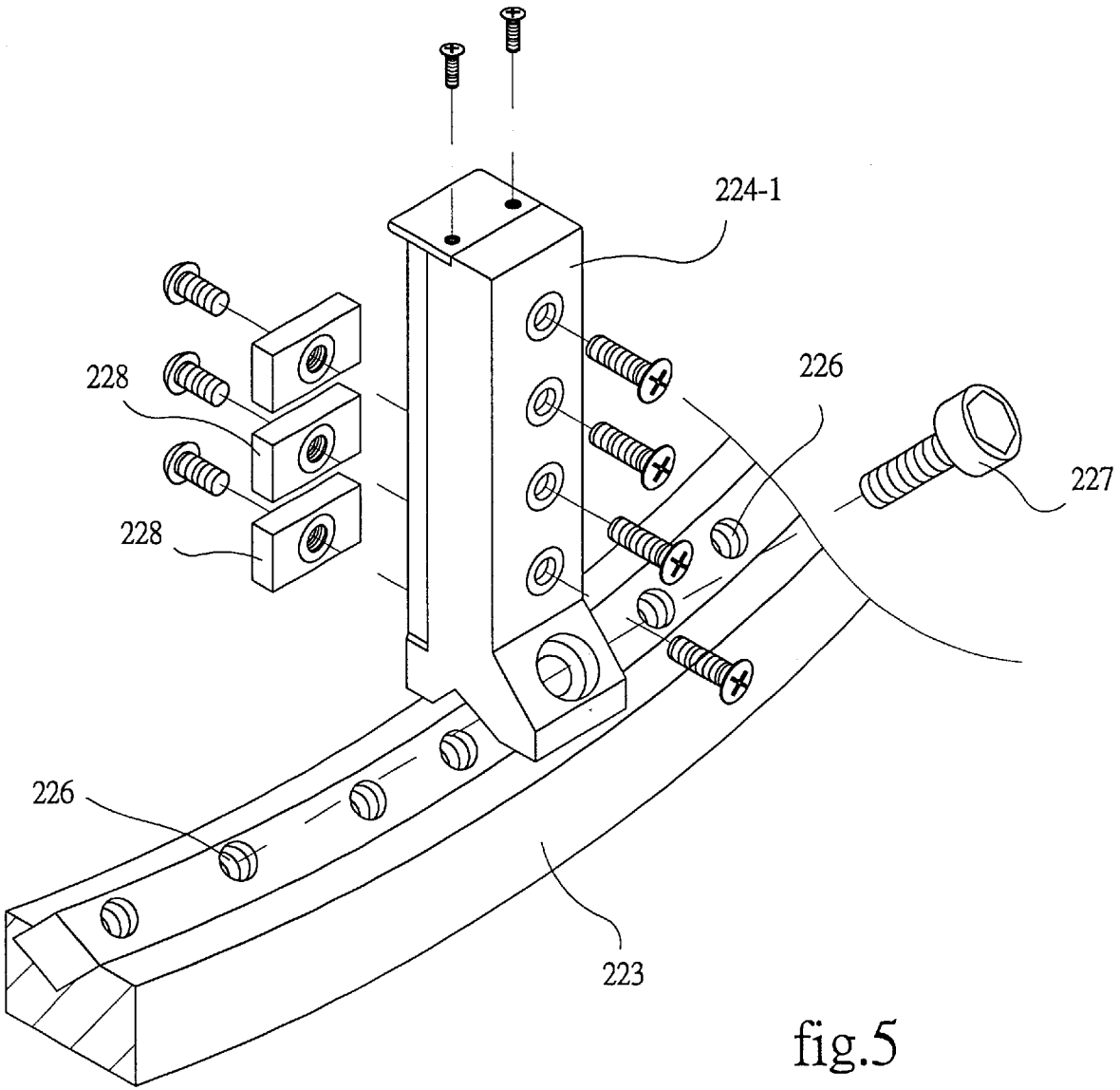
FIG. 5 is the explosive view of the block of the upper block ring and circular seat of the upper cylinder mechanism.

As shown in FIGS. 4 & 5, a plurality of screw holes (215 in FIG. 4) (226 in FIG. 5) are disposed at the circle of the circular seat (213) and bottom seat (223) while the blocks (214-1 in FIG. 4) (224-1 in FIG. 5 ) are secured thereon through screws (216 in FIG. 4) (227 in FIG. 5 ) inserting into the screw holes (215 in FIG. 4) (226 in FIG. 5). Moreover, the sinkers (217 in FIG. 4) (228 in FIG. 5) with needle track therein are also fixed onto the blocks of upper block ring (214-1) and the lower block ring (224-1) by screws and then form closed tracks for needles.

Figure 6:
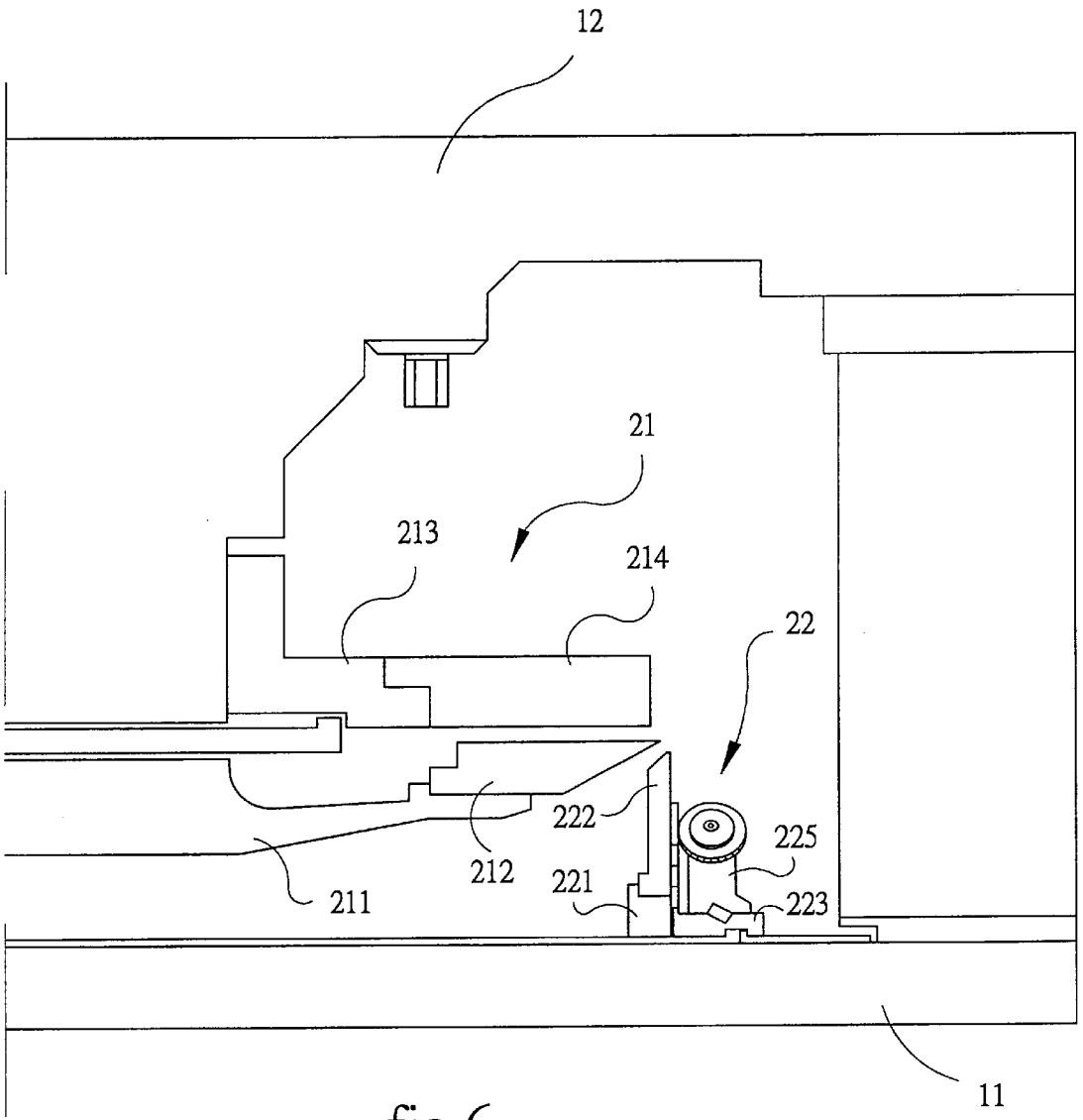
FIG. 6 is the parts location view of the present invention as double jacquard machine.

As a double jacquard machine, referring to FIGS. 3 & 6, the present invention only needs to replace the upper cylinder (212) and upper block ring (214) with the ones specific for jacquard and the pattern wheels (225) for jacquard are substituted for the lower block ring (224). Accordingly, the present invention shifts from producing double knit to producing double jacquard.

Referring to FIGS. 3 & 7, another embodiment of the present invention provides a knitting machine which is adapted to be converted from producing double knit fabric to producing single knit fabric. The upper cylinder seat (211) and the upper cylinder (212) are detached while an upper block ring (214) is replaced by a dust cleaning system (23). Moreover, the upper support rack (24) is arranged on the base (11) by the lower support arms (241), surrounding the lower cylinder mechanism (22). A set of rings for fixing thread (25) are mounted on the upper support rack (24) by the upper support arms (251). The lower cylinder mechanism (22) is also adjusted to have a lower cylinder (222) and the lower block ring (224) suitable for single knit.

Figure 8:
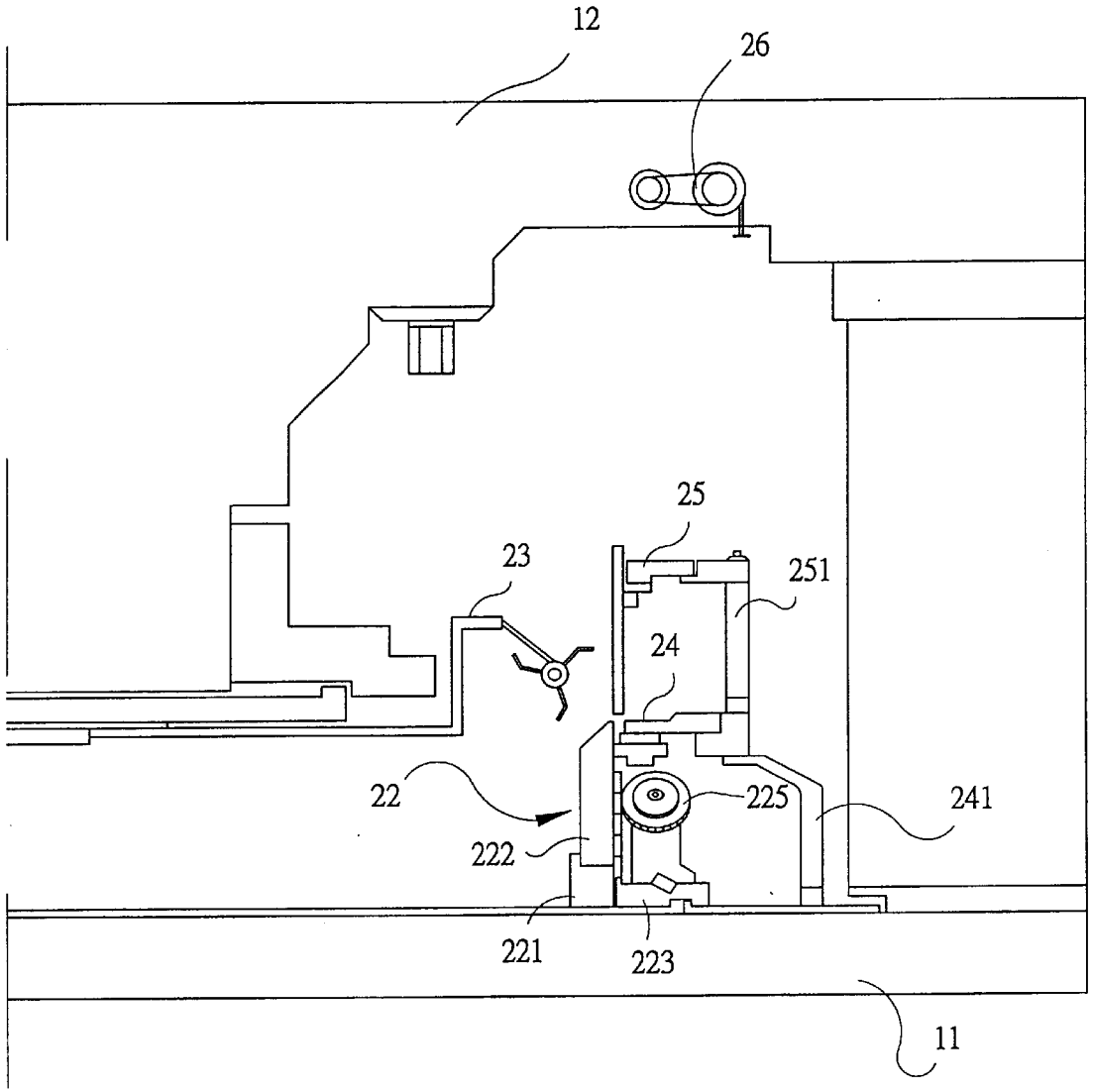
FIG. 8 is the parts location view of the present invention as single jacquard machine.

Referring to FIGS.7 & 8, another embodiment of the present invention provides a single knit jacquard machine which converts from producing single knit fabric to producing single jacquard fabric. The upper support rack (24) and the rings for fixing thread (25) are suspended by the winding machine (26), then detached the lower block ring (224) and replace needles in the lower cylinder (222). The blocks (224-1) of the lower block ring (224) are replaced by the pattern wheels (225). The upper support rack (24) and the rings for fixing thread (25) are arranged in their original place.

It should be pointed out that, the embodiment of the present invention in FIG. 7 for producing single knit fabric can be converted to produce plain terry fabric. Components, such as a lower cylinder (222) and the needles inside, lower block ring (224), upper support rack (24) and rings for fixing thread (25), need to be replaced with the ones specific for producing plain terry.

While a preferred embodiment of the invention has been shown and described in detail, it will be readily understood and appreciated that numerous omissions, changes and additions may be made without departing from the spirit and scope of the invention.

What is claimed is:

1. In a circular knitting machine having a mechanical main body, a cylindrical mechanism for carrying a plurality of needles, yarn feeders and a fabric winding system, the improvement comprising:

said cylinder mechanism including an upper cylinder mechanism and a lower cylinder mechanism;

a base for supporting a lower cylindrical seat having a receiving portion circumferentially located along its periphery, said lower cylindrical mechanism being mounted onto said receiving portion of said lower cylindrical seat;

a main strut for supporting a circular seat having a receiving portion circumferentially located along its periphery, said upper cylindrical mechanism being mounted to said receiving portion of said circular seat, wherein said upper cylindrical portion is located above said lower cylindrical portion, and said main strut and said base are arranged to synchronously rotate around a same axis;

whereby said knitting machine can be converted to produce a variety of different types of fabrics by replacing the upper cylinder mechanisms and lower cylinder mechanisms with appropriate mechanisms.

2. The improvement of claim 1 in a circular knitting machine wherein said upper mechanism is a radial dust cleaning system.

3. The improvement of claim 1 in a circular knitting machine wherein said upper mechanism includes a set of rings for feeding thread.

4. The improvement of claim 1 in a circular knitting machine wherein said upper mechanism includes an upper support rack.

* * * * *